US011525266B2

(12) United States Patent
Wimmer

(10) Patent No.: US 11,525,266 B2
(45) Date of Patent: Dec. 13, 2022

(54) SNOW MELT SYSTEM FOR A ROOF

(71) Applicant: Eric L. Wimmer, Ogden, UT (US)

(72) Inventor: Eric L. Wimmer, Ogden, UT (US)

( * ) Notice: Subject to any disclaimer, the term of this patent is extended or adjusted under 35 U.S.C. 154(b) by 202 days.

(21) Appl. No.: 16/245,956

(22) Filed: Jan. 11, 2019

(65) Prior Publication Data

US 2019/0218785 A1 Jul. 18, 2019

Related U.S. Application Data

(60) Provisional application No. 62/616,998, filed on Jan. 12, 2018.

(51) Int. Cl.
*E04D 13/10* (2006.01)
*H05B 3/06* (2006.01)

(52) U.S. Cl.
CPC ..... *E04D 13/103* (2013.01); *H05B 3/06* (2013.01)

(58) Field of Classification Search
CPC ..... E04D 13/103; H05B 3/06
See application file for complete search history.

(56) References Cited

U.S. PATENT DOCUMENTS 4,081,657 A * 3/1978 Stanford ..... E04D 13/103 338/285
5,836,344 A * 11/1998 Hovi, Sr. ..... E04D 13/103 137/357
8,946,601 B2 * 2/2015 Casey ..... E04D 13/103 219/213
9,909,319 B1 * 3/2018 Voress ..... E04D 13/076
2011/0047892 A1 * 3/2011 Nark ..... E04D 13/103 52/95
2011/0297662 A1 * 12/2011 Clark ..... E04D 13/103 219/213
2014/0326837 A1 * 11/2014 Rumsey ..... F16L 3/06 248/65

OTHER PUBLICATIONS

Installation Guide for HotEdge Rail.

* cited by examiner

*Primary Examiner* — Erin E McGrath
(74) *Attorney, Agent, or Firm* — Dobbin IP Law, P.C.; Geoffrey E. Dobbin

(57) ABSTRACT

A snow and ice melt system for a roof may feature heat plates which protect and contact heat cable to distribute heat over a wider area than cable alone. Bends in the plates create attachment structures by which the plates are assembled and by which heat cable is contained.

2 Claims, 10 Drawing Sheets

SNOW MELT SYSTEM FOR A ROOF

CROSS-REFERENCES TO RELATED APPLICATIONS

This Application claims priority as a non-provisional perfection of prior filed U.S. Application No. 62/616,998, filed Jan. 12, 2018 and incorporates the same by reference herein in its entirety.

FIELD OF THE INVENTION

The present invention relates to the field of weather amelioration and more particularly relates to a plate system which distributes heat in a manner to melt snow accumulation on a rooftop.

BACKGROUND OF THE INVENTION

In colder climates, winter typically brings precipitation in the form of snow. Unlike rain, which maintains its fluid nature and seeks the ground when it lands on a structure, snow accumulates on a structure until it melts. Sometimes, this can create problems as rain gutters and downspouts may clog with snow and prevent proper drainage. Typically, this occurs when snow accumulates by the edge of the roof, over or near the gutter, and then freezes into a more solid block of ice. When this occurs, snow can melt behind this ice dam and form a pool of water on the roof itself. This will damage the shingle and roof surface and can cause significant damage to a building's roof. If left untreated the melt water will find a new path of flow and often ends up inside the building.

One method of preventing this occurrence is to place heating cables along the roof line. Heating cables are typically a high voltage and high resistance cable which generates heat when activated. This heat melts snow and any ice forming along the roof line and keeps the gutters and area around them clear. Usually, when snow is melted in this fashion, it does not tend to refreeze while it is drained off the roof. However, these cables are exposed on the roof and are usually deployed in a tight serpentine pattern as air does not conduct heat well and much of the thermal energy generated by the cable is lost as distance from it increases. As they are exposed, they can face potential damage from the elements over the course of a year. As they are tightly serpentine in their deployment, a large length of cable is usually required for a short span of roof. A new apparatus which can not only protect the cable but also lessen the length of cable needed to adequately protect a roof surface would be a benefit to the industry.

The present invention is a plating apparatus which not only secures cables to the roof, but also evenly distributes heat from the cables to a much further distance away from the cable than the cable can conduct alone. As such, less cable is needed for effective snow and ice melting and the cable remains protected throughout the year.

The present invention represents a departure from the prior art in that the system of the present invention provides a plate structure which is easily assembled and installed on a roof which also protects the cables and efficiently distributes heat from said cables in a manner which greatly lessens the length of cable needed to adequately protect a roof.

SUMMARY OF THE INVENTION

In view of the foregoing disadvantages inherent in the known types of snow melt systems, an improved snow melt system may provide a protective plate which anchors and contacts a snow melt cable to more evenly distribute heat. Such a system should meet the following objectives: be cost effective in its construction, be easily installed, adequately protect heating cables during their useful lifetime, allow said cables to be replaced at the end of their useful lifetime, accommodate various cable sizes, and efficiently distribute heat from the cables in a manner to more effectively melt snow and ice from along a roof line As such, a new and improved snow melt system may comprise a plurality of metal plates which are configured to not only contact and support the cables, but also clip together and be secured under roofing shingles in order to accomplish these objectives.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of the snow melt system is herein described. It should be noted that the articles "a", "an", and "the", as used in this specification, include plural referents unless the content clearly dictates otherwise.

Figure 1:
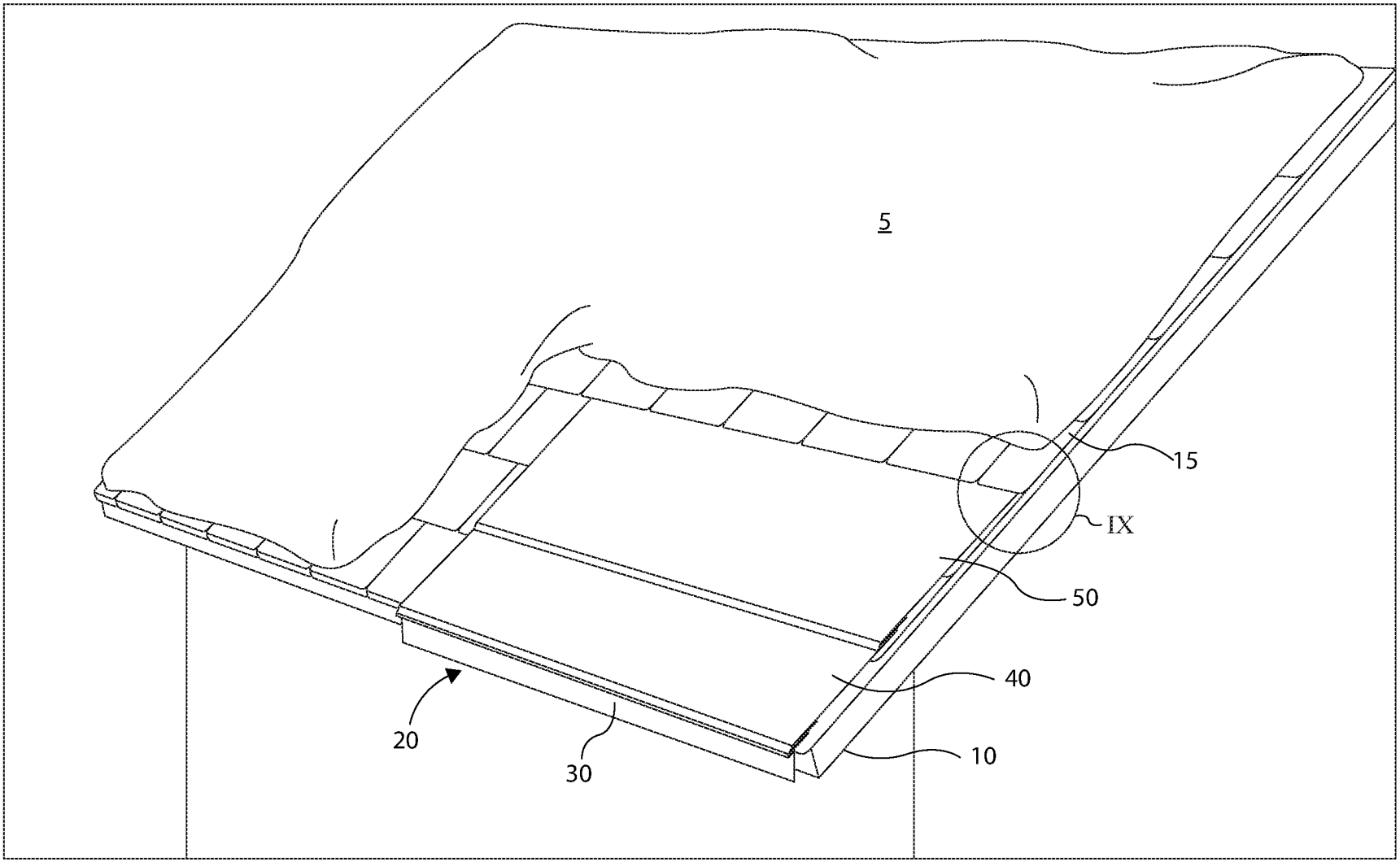
FIG. 1 is a perspective view of a snow-covered roof, with an exemplary snow melt system partially installed.
Figure 2:
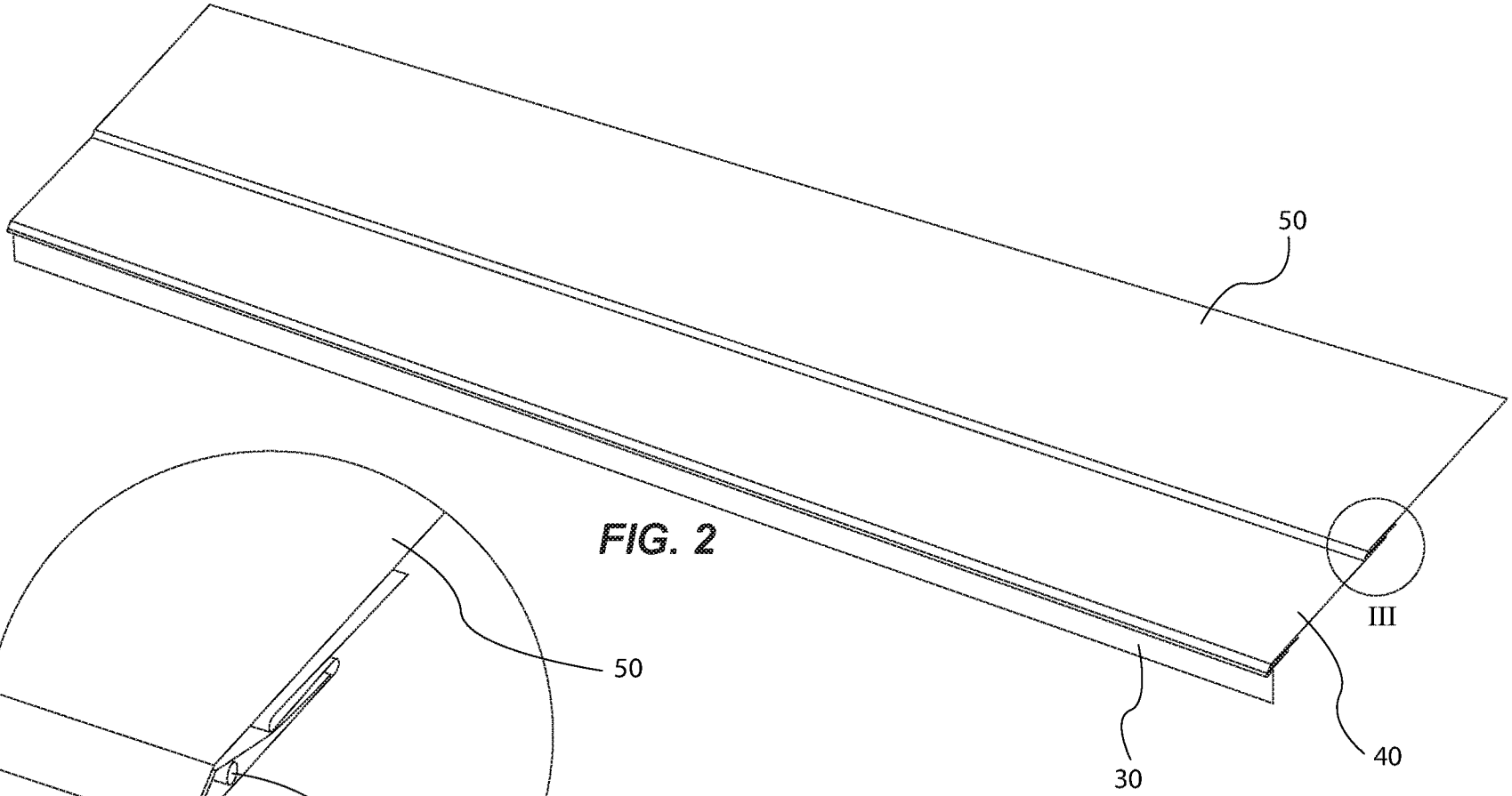
FIG. 2 is a perspective view of the snow melt system utilized in FIG. 1.
Figure 3:
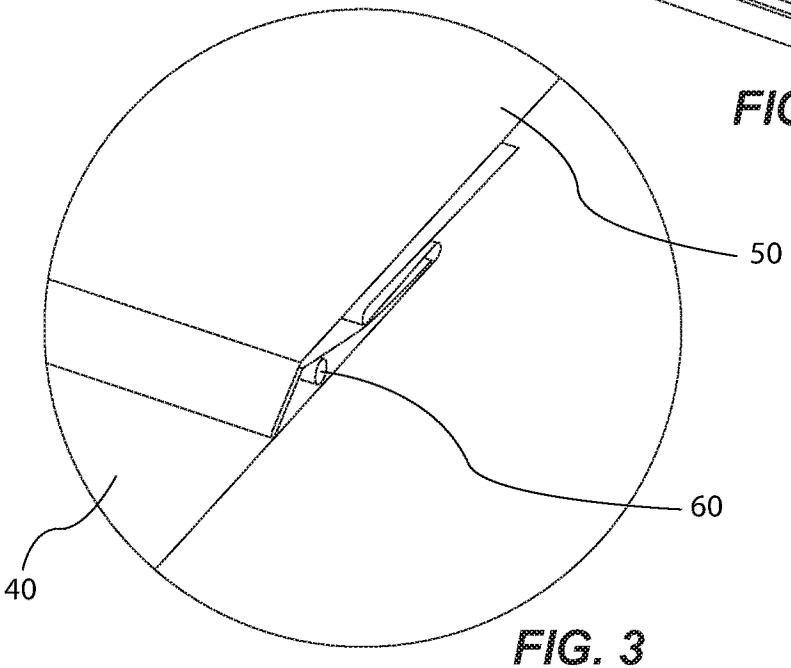
FIG. 3 is a close-up view of the snow melt system of FIG. 2, taken in circle III.

With reference to FIG. 1, a snow-covered roof 10 is depicted, with one side utilizing an exemplary embodiment of the snow melt system 20. The side of the roof without the system remains covered in snow 5, while the snow melt system 20 effectively melts snow near the edge of the roof 10. The depicted snow melt system 20 (FIGS. 2 and 3) features four components: a drip edge cover 30, a middle plate 40, a terminal plate 50 and a heat cable 60.

Figure 4:
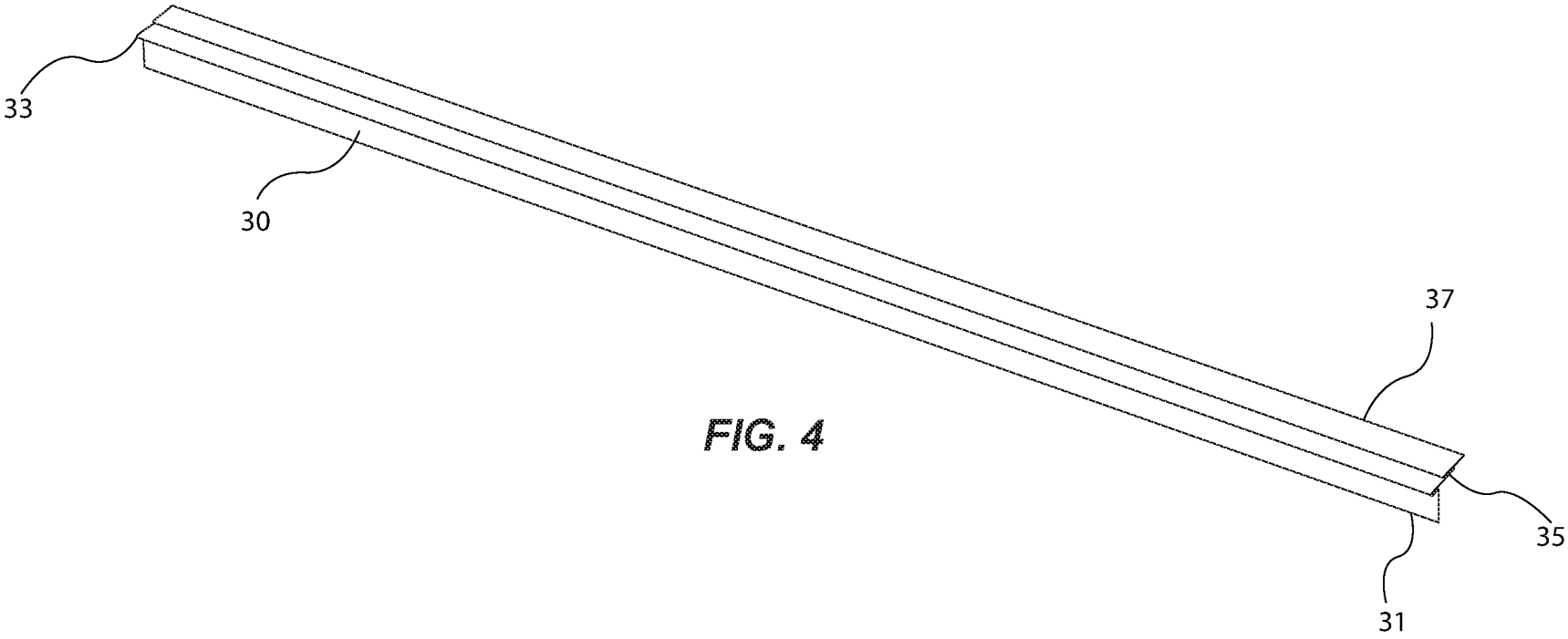
FIG. 4 is a perspective view of the drip edge cover utilized in the snow melt system of FIG. 1

Drip edge cover 30 (FIG. 4) is a rectangular plate which has been bent to accommodate the edge of the roof. Its upper longitudinal edge 37 serves as an attachment, or anchor, strip and may be attached to the roof by any known or later discovered roof attachment means, including nails, staples, or glue and other adhesives. An S-bend 35 is located slightly beneath the anchor strip 37. The cover is then folded over itself slightly, creating a protrusion, or cable platform 33, before it angles downward at an approximately right angle and terminates at is lower edge 31.

The protrusion provides a flat surface for interacting with the heat cable and next successive plate, which in the depicted embodiment is the middle plate 40.

Figure 5:
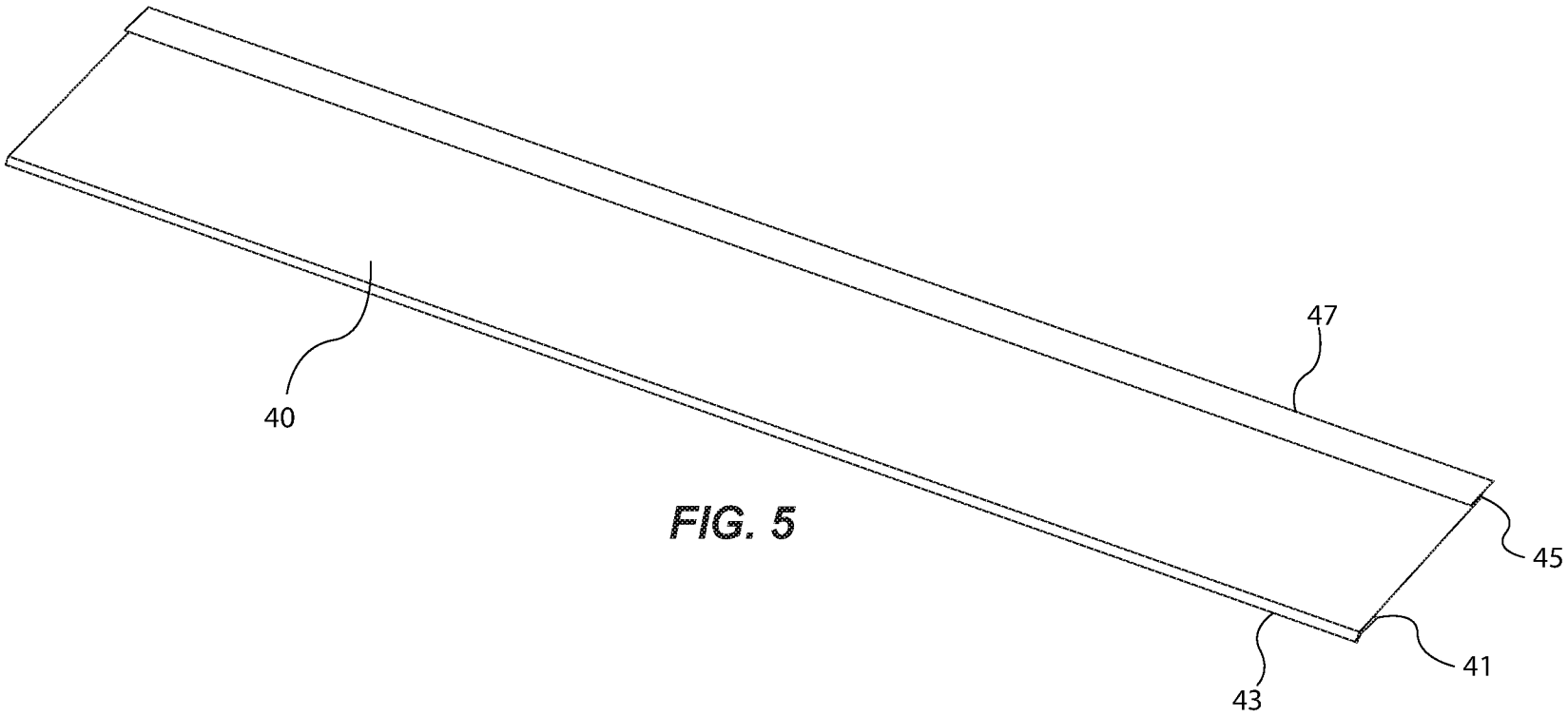
FIG. 5 is a perspective view of the middle plate utilized in the snow melt system of FIG. 1.
Figure 6:
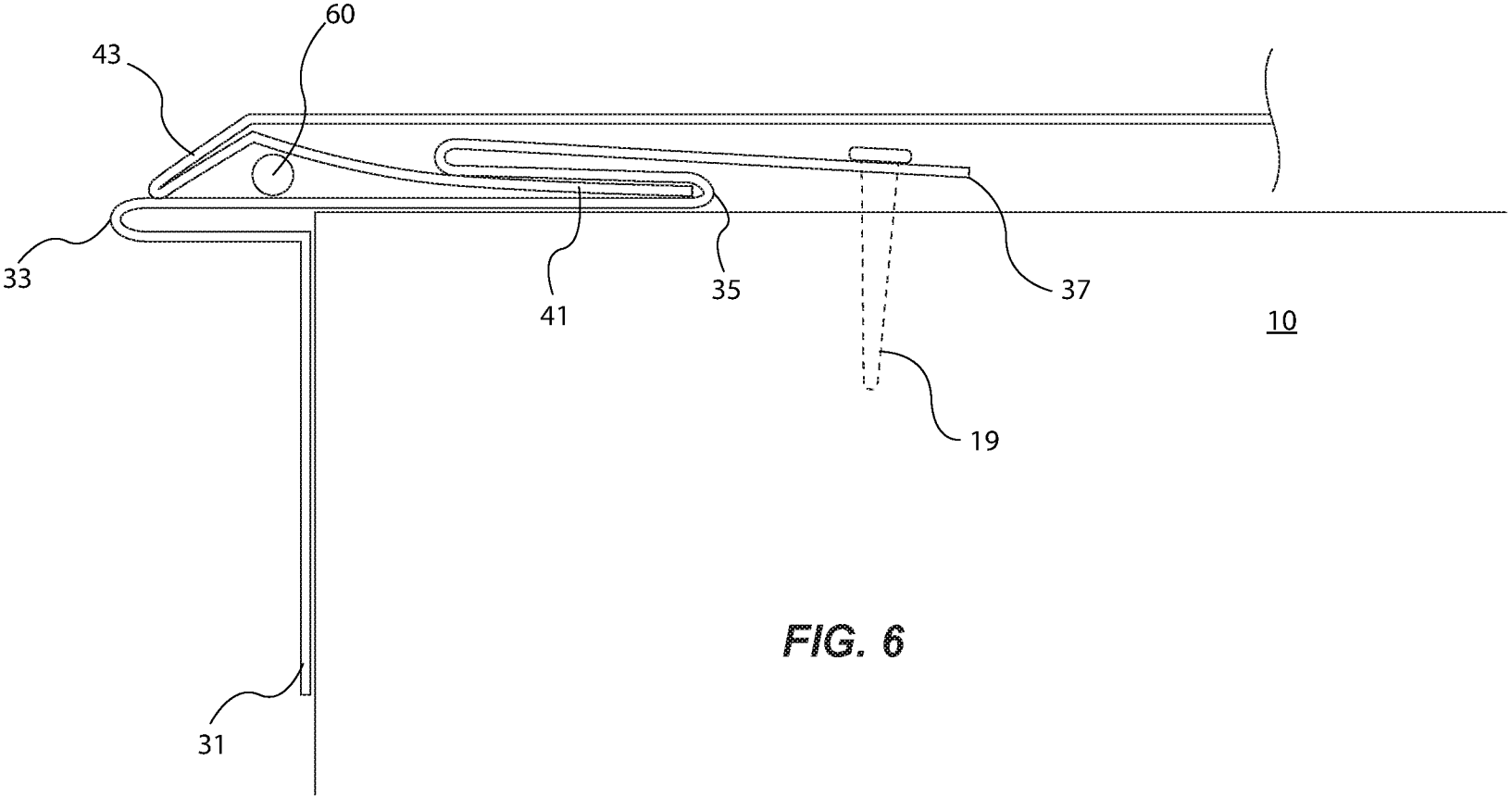
FIG. 6 is a side elevation of the drip edge cover of FIG. 4 and middle plate of FIG. 5 joined, with a heating cable.

The middle plate 40 (FIG. 5) is essentially rectangular with two longitudinal edges. As with the drip edge cover, upper edge 47 serves as an anchor strip and may be fastened to the roof. Proximate the upper edge 47 is an S-bend 45 like that of the drip edge cover 30. The lower edge is folded over itself and bent in a slight V-bend to form a cable containment lip 43 while the edge itself 41 becomes an insert for the drip edge cover's S-bend 35. The interaction of these pieces is shown in FIG. 6. The lower edge 41 of the middle plate 40 is fitted into the S-bend 35 of the drip edge cover 30. The containment lip 43 and cable platform 33 combine to form a chamber in which cable 60 may reside. It is ideal that the cable 60 be wedged into the chamber and maximize its contact with both the drip edge cover 30 and middle cover 40 to promote thermal conduction. The middle plate 40 then covers the remainder of the drip edge cover 30, including the attachment strip 37. This arrangement prevents water from interacting with the roof attachment means.

Figure 7:
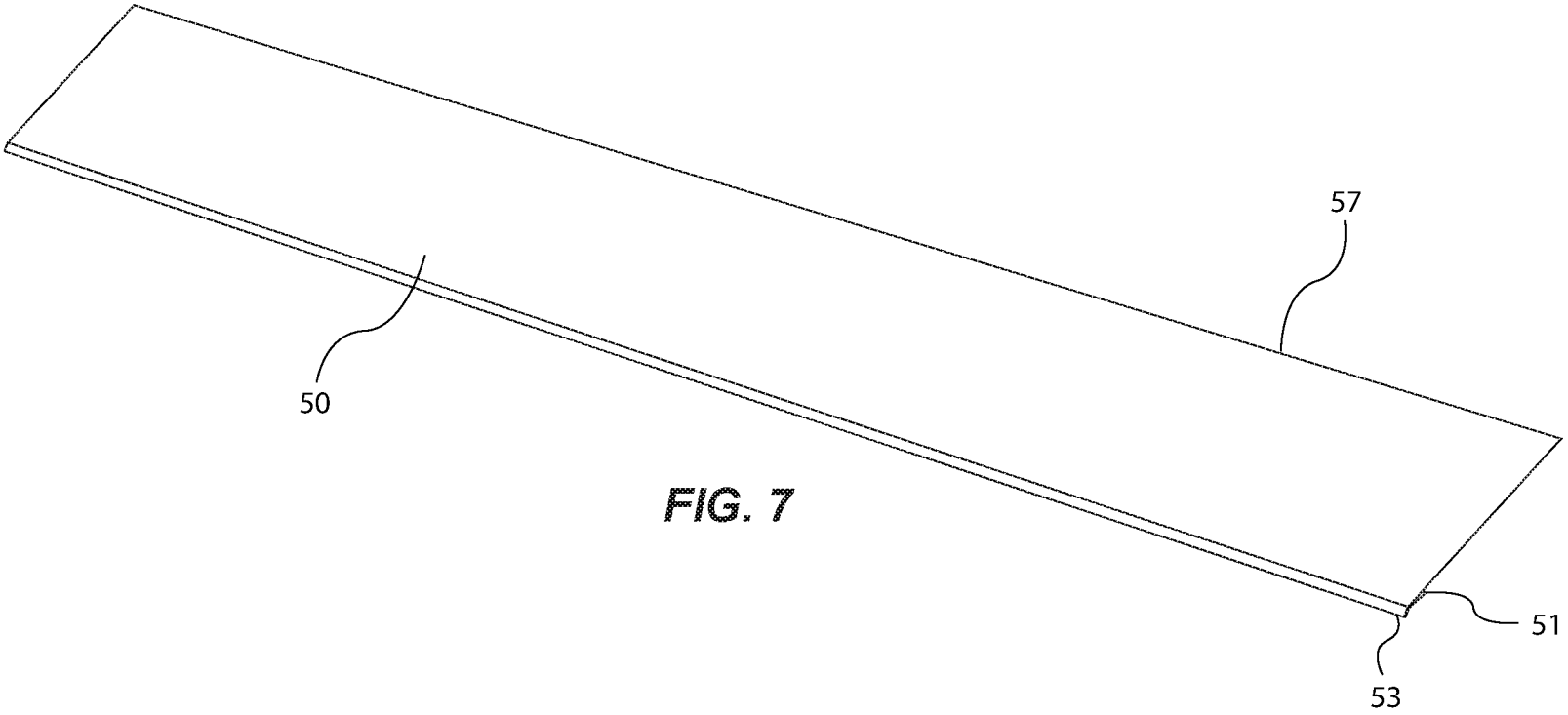
FIG. 7 is a perspective view of the terminal plate utilized in the snow melt system of FIG. 1.
Figure 8:
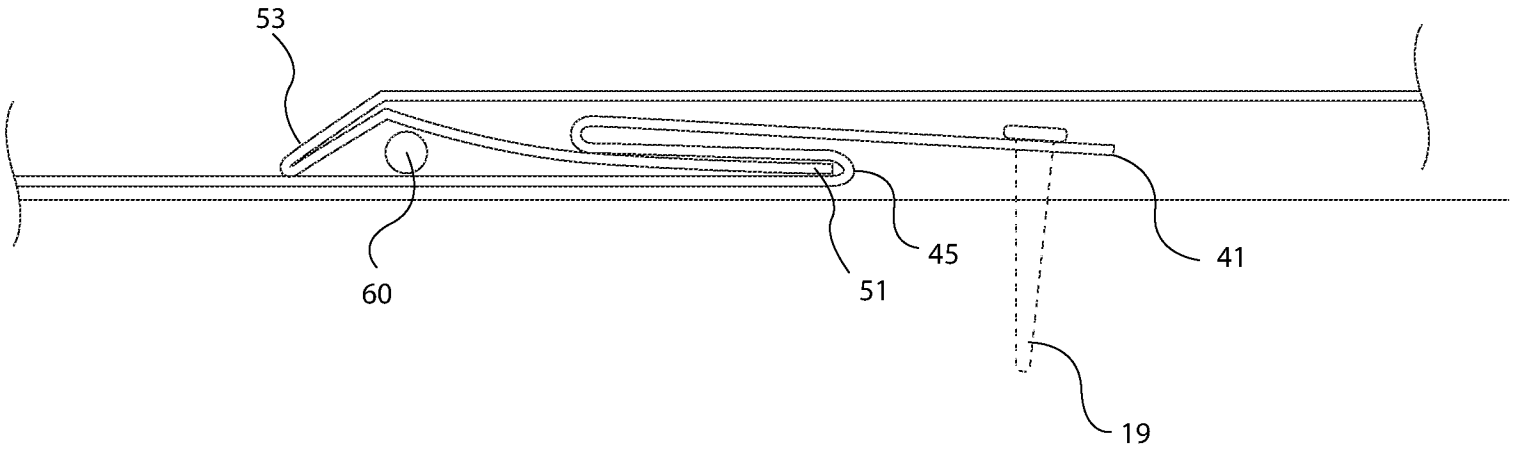
FIG. 8 is a side elevation of the terminal plate of FIG. 7 and middle plate of FIG. 5 joined, with a heating cable.
Figure 9:
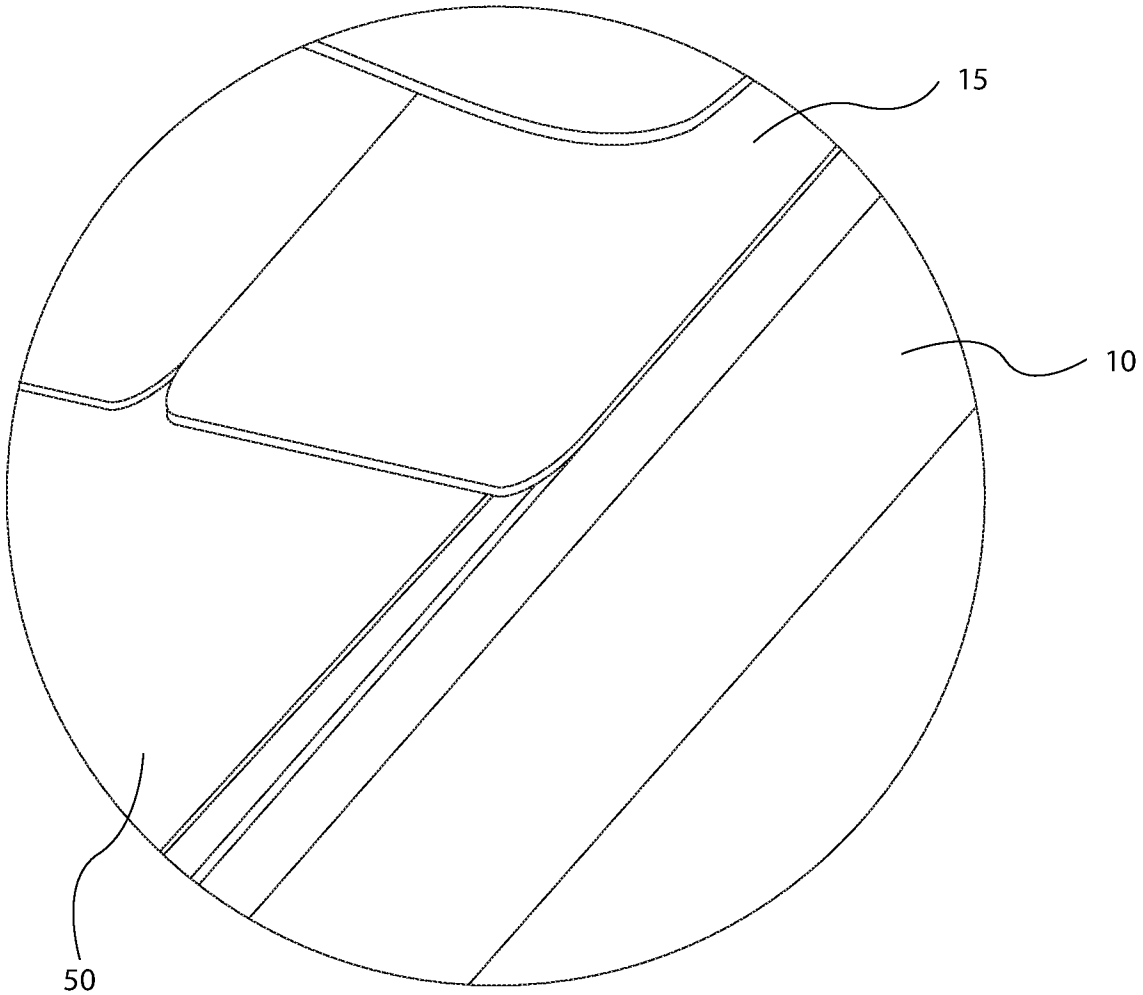
FIG. 9 is a close-up view of the snow melt system of FIG. 1, taking in circle IX, detailing its interface with the roof shingles.

The terminal plate 50 features the same containment lip structure 53 as the middle plate, with its lower end folded over as an attachment insert 51 (FIG. 7). It does not feature an S-bend, but rather terminates at its upper edge 57. It interfaces with the middle plate in exactly the same manner as the middle plate 40 interfaces with the drip edge cover 30 (FIG. 8), which is to say that the attachment insert 51 is positioned in the middle plate's S-bend 45 and the containment lip 53 forms a chamber in combination with the body of the middle plate 40 for heat cable 60. It totally covers the anchor strip 47 of the middle plate and it, too, is fastened to the roof at its upper edge 57 and has its edge covered by shingles (FIG. 9). In so doing, each successive upper layer to the system protects the lower layers' attachment to the roof.

Figure 10:
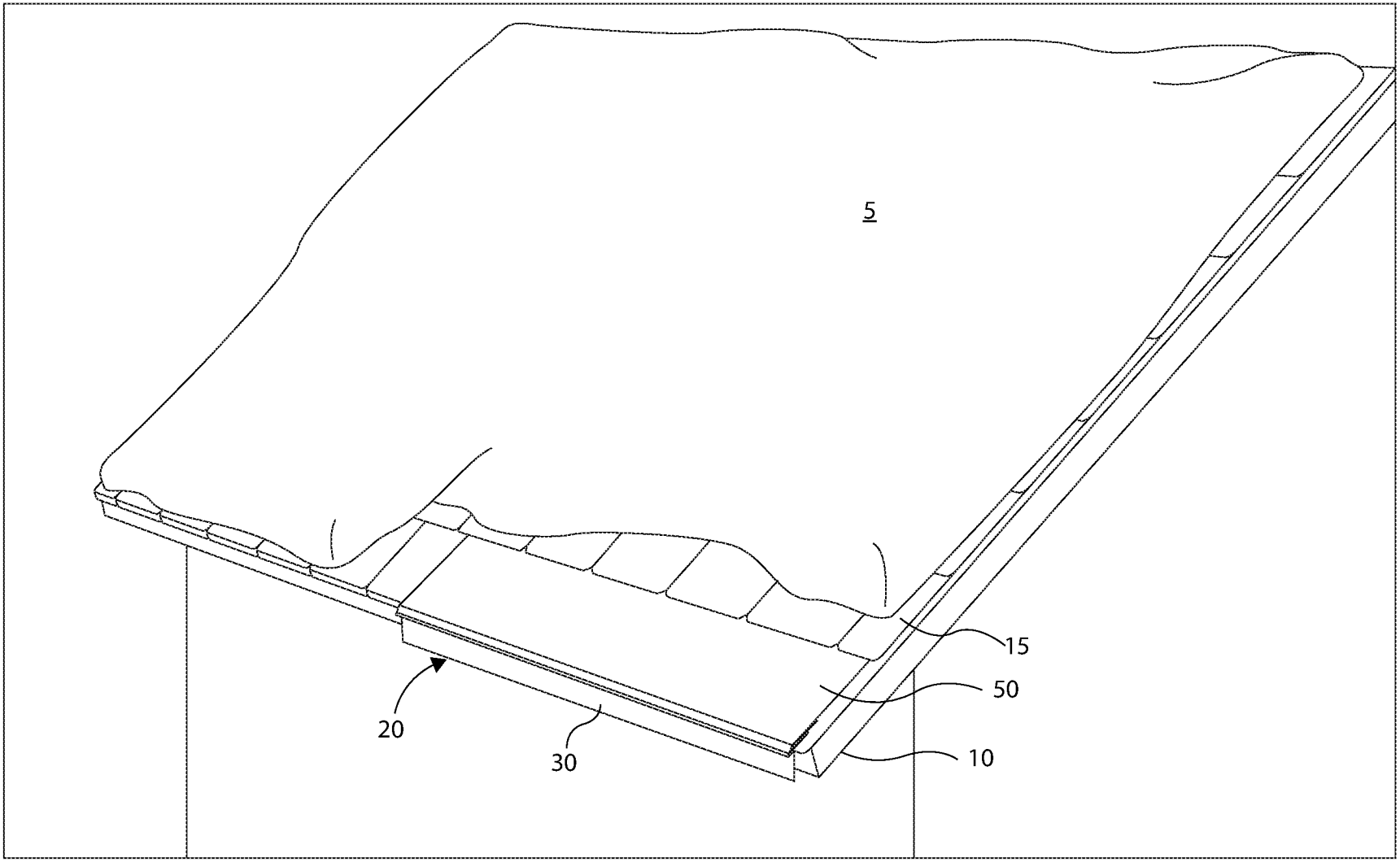
FIG. 10 is a perspective view of a snow-covered roof, with an alternate snow melt system partially installed.
Figure 11:
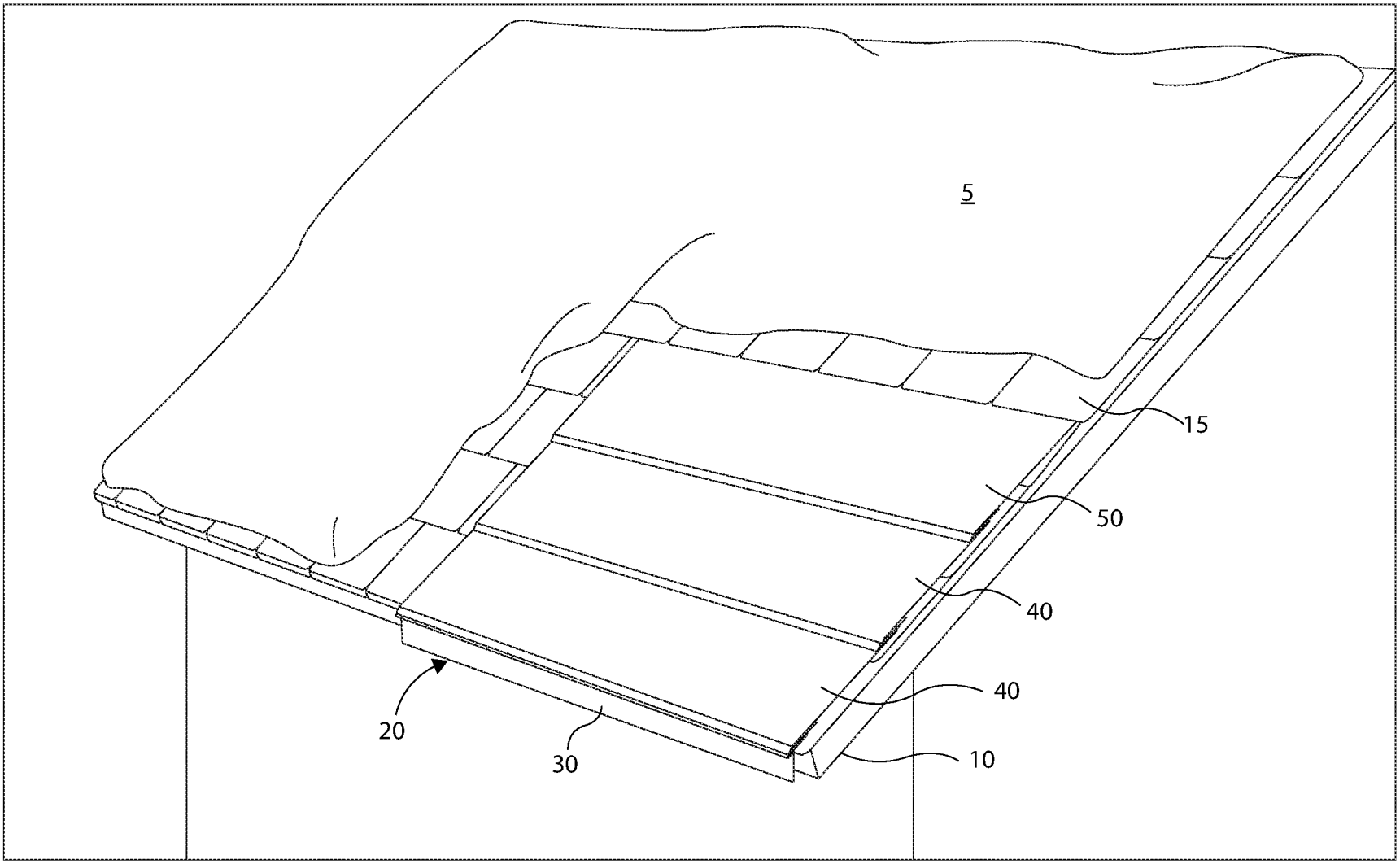
FIG. 11 is a perspective view of a snow-covered roof, with a further alternate snow melt system partially installed.

Variations to the system are possible. As can be seen in FIG. 10, the terminal plate 50 may be attached directly to the drip edge cover 30 or, as in FIG. 11, at least one additional middle plate may be added to the system. Since the attachment methodology is uniform with each plate, any number of middle plates may be utilized.

Metal alloys are the preferred material from which the plates and drip edge cover may be formed. Many metals are notorious for their thermal conductivity and their elastic and plastic deformation ranges are such that permanent bends, such as the S-bends and the containment lips, may be easily and permanently formed while the structure may retain enough elasticity so that the pieces may be locked together and hold the heat cables. The ideal dimensions of the individual plates will vary depending upon the actual material from which they are made and the intended roofing material. A length between 3-4 feet (0.9-1.2 meters) provides good coverage while also being manageable for installation while smaller length plates may be utilized as caps for even coverage over a roof without cutting the plates. It is ideal that the plates have enough width to cover at least one exposed shingle face (typically 6 inches) or a roofing tile (12 inches) and have some overlap to fit underneath the next higher row of roofing material. The width should be enough to cover at least one type of roofing material, if not two, and have some overlap with the other plates and/or adjacent roofing material row. The only other concern for a maximum width is that the plate will conduct heat throughout its entire width. Therefore, a width of 12 to 14 inches (0.30 to 0.35 meters) is currently recommended, but a width of as little as 6 inches (0.15 meters) could be utilized.

Heat cables 60 may be threaded through the space formed by the containment lips or may be positioned as each plate is installed. They may also be slipped under each lip, using the metal's elasticity to harmlessly create enough space for installation. Removal and replacement of the cable 60 may be accomplished by either pulling it out, or by slipping it under the lip as well. The elasticity of the metal allows the lips to contain heat cable 60 in one position in the system, allowing for uniform operation. The lips may also accommodate various sizes of cable, including cable slightly larger than the space allotted by the lip construction. It is ideal for at least some contact to be had between the plates and the cable, generally with more being more effective.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A snow melt system for a roof, the system comprising:

a length of heat cable;

at least one drip edge cover, a lower portion of said drip edge cover residing over an edge of the roof and an upper portion of the drip edge cover residing on a top surface of the roof and being fastened thereto, the drip edge cover further comprising a first S-bend across a length of the upper portion of the drip edge cover, at least one thermally conductive middle panel having upper and lower edges along a length and further comprising a second S-bend across the length towards the upper edge of said middle panel, the middle panel residing on the top surface of the roof and being fastened thereto proximate the upper edge of the middle panel while overlapping a portion of the upper portion of the drip edge cover with the lower edge of middle panel being bent-over such that the lower edge may interface with the first S-bend;

at least one thermally conductive top panel having upper and lower edges along a length, the top panel residing on the top surface of the roof and being fastened thereto proximate the upper edge of the top panel such that a portion of the top panel overlaps a portion of the at least one middle panel with the lower edge of the top panel being bent-over such that the lower edge of the top panel may interface with the second S-bend; and a plurality of cable containment chambers, at least one formed in each of areas defined by the overlaps of the at least one middle panel over the upper portion of the drip edge cover and the top panel over the middle panel such that the heat cable may pass within said areas and be totally contained therein;

wherein, while the system is assembled by connecting the lower edge of the middle panel to the S-bend of the drip edge cover and the lower edge of the top panel is attached to the second S-bend in the middle panel.

2. The snow melt system of claim 1, the bent-over lower edge further comprising a V-bend which forms the cable containment chamber.

* * * * *